US009176418B2

(12) United States Patent
Tsuda et al.

(10) Patent No.: US 9,176,418 B2
(45) Date of Patent: Nov. 3, 2015

(54) DEVELOPER CONVEYANCE APPARATUS AND PROCESS CARTRIDGE

(75) Inventors: Satoshi Tsuda, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 13/612,551

(22) Filed: Sep. 12, 2012

(65) Prior Publication Data

US 2013/0084106 A1 Apr. 4, 2013

(30) Foreign Application Priority Data

Sep. 29, 2011 (JP) ..... 2011-215332
Sep. 29, 2011 (JP) ..... 2011-215333

(51) Int. Cl.
*G03G 15/00* (2006.01)
*G03G 15/08* (2006.01)
*G03G 21/18* (2006.01)

(52) U.S. Cl.
CPC ..... *G03G 15/0865* (2013.01); *G03G 15/0891* (2013.01); *G03G 21/18* (2013.01); *G03G 21/1814* (2013.01); *G03G 21/1821* (2013.01); *G03G 15/00* (2013.01); *G03G 15/0822* (2013.01); *G03G 15/0832* (2013.01); *G03G 15/0837* (2013.01); *G03G 15/0839* (2013.01); *G03G 2215/0692* (2013.01)

(58) Field of Classification Search
CPC ..... G03G 15/00
USPC ..... 399/258
See application file for complete search history.

(56) References Cited

U.S. PATENT DOCUMENTS

| | | | | |
|---|---|---|---|---|
| 6,625,404 | B2 * | 9/2003 | Watanabe et al. | 399/30 |
| 7,110,707 | B2 * | 9/2006 | Nishitani | 399/258 |
| 7,187,876 | B2 * | 3/2007 | Ito et al. | 399/27 |
| 7,248,825 | B2 * | 7/2007 | Nishitani et al. | 399/258 |
| 8,036,575 | B2 * | 10/2011 | Tsuda | 399/254 |
| 8,150,277 | B2 * | 4/2012 | Takiguchi | 399/27 |
| 8,489,000 | B2 * | 7/2013 | Kawaguchi | 399/257 |
| 2002/0009309 | A1 * | 1/2002 | Suzuki | 399/254 |

(Continued)

FOREIGN PATENT DOCUMENTS

| | | |
|---|---|---|
| JP | 02-021661 U | 2/1990 |
| JP | 07-301983 A | 11/1995 |

(Continued)

*Primary Examiner* — Clayton E LaBalle
*Assistant Examiner* — Kevin Butler
(74) *Attorney, Agent, or Firm* — Canon USA, Inc. IP Division

(57) ABSTRACT

A developer conveyance apparatus for an image forming apparatus includes a developer storage portion, a developer conveyance portion arranged inside the developer storage portion and, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and includes at least one clutch side conveyance portion which, when receiving the drive force from the drive input portion, conveys the developer in a developer conveyance direction in which the developer conveyance portion conveys the developer.

16 Claims, 13 Drawing Sheets

(56) References Cited

U.S. PATENT DOCUMENTS

| | | | | |
|---|---|---|---|---|
| 2003/0072590 | A1* | 4/2003 | Shimaoka et al. | 399/258 |
| 2005/0002700 | A1* | 1/2005 | Nishitani | 399/258 |
| 2005/0117919 | A1* | 6/2005 | Ito et al. | 399/27 |
| 2006/0104670 | A1* | 5/2006 | Nishitani et al. | 399/258 |
| 2006/0120779 | A1 | 6/2006 | Uchihashi | |
| 2013/0058670 | A1* | 3/2013 | Nakatake et al. | 399/53 |
| 2013/0084106 | A1* | 4/2013 | Tsuda et al. | 399/258 |
| 2013/0121721 | A1* | 5/2013 | Horikawa et al. | 399/106 |
| 2013/0121724 | A1* | 5/2013 | Nittani | 399/111 |

FOREIGN PATENT DOCUMENTS

| | | | | | |
|---|---|---|---|---|---|
| JP | hei11-160985 | A | | 6/1999 | |
| JP | 11-231623 | A | | 8/1999 | |
| JP | 2006-162941 | | * | 6/2006 | G03G 21/10 |
| JP | 2006-162941 | A | | 6/2006 | |
| JP | 2006162941 | | * | 6/2006 | G03G 21/10 |
| JP | 2009-116039 | | * | 5/2009 | G03G 15/08 |
| JP | 2009-116039 | A | | 5/2009 | |
| JP | 2010-014890 | | * | 1/2010 | G03G 15/08 |
| JP | 2010-014890 | A | | 1/2010 | |
| JP | 2010014890 | | * | 1/2010 | G03G 15/08 |

* cited by examiner

DEVELOPER CONVEYANCE APPARATUS AND PROCESS CARTRIDGE

This application claims priority from Japanese Patent Applications No. 2011-215332 filed Sep. 29, 2011 and No. 2011-215333 filed Sep. 29, 2011, which are hereby incorporated by reference herein in their entirety.

BACKGROUND OF THE INVENTION

1. Field of the Invention

The present disclosure relates to a developer conveyance apparatus for use in an image forming apparatus, and to a process cartridge equipped with the developer conveyance apparatus.

In the context of the present specification, a developer conveyance apparatus is an apparatus for conveying developer for image formation. For example, the developer conveyance apparatus includes a process cartridge, a developer replenishment cartridge, and a developer conveyance portion in an electrophotographic image forming apparatus.

An image forming apparatus is an apparatus configured to form an image on a recording medium. The image forming apparatus includes an electrophotographic copying machine, an electrophotographic printer (such as a light emitting diode (LED) printer and a laser beam printer), and an electrophotographic facsimile apparatus, all of which are configured to form an image on a recording medium by using an electrophotographic image forming process.

A recording medium is a substance on which an image is formed. The recording medium includes a recording sheet and an overhead projector (OHP) sheet.

2. Description of the Related Art

Conventionally, there has been known a process cartridge system in which an electrophotographic photosensitive member in an image forming apparatus and a process unit acting thereon are integrated into a cartridge, which is detachably attachable to the image forming apparatus main body. The process cartridge system helps to achieve an improvement in terms of operability since it enables the user to perform maintenance on the apparatus.

The process cartridge is formed by a cleaning device (hereinafter referred to as a cleaning unit), and a development device (hereinafter referred to as a development unit). The cleaning unit includes an image bearing member as the electrophotographic photosensitive member, and a cleaning member configured to clean the surface of the image bearing member. The development unit includes a development roller configured to supply developer to the image bearing member, and a developer storage portion storing developer.

On the other hand, as an example of a process cartridge system, a developer replenishment system is known. In this system, a developer replenishment opening of a developer replenishment cartridge and a developer reception port of a process cartridge are connected to each other, and developer is replenished from the developer replenishment cartridge to the process cartridge.

In the developer replenishment system, when new developer replenished from the developer replenishment cartridge and old developer in the development unit are unevenly mixed with each other, image trouble is caused. In view of this, as discussed, for example, in Japanese Patent Application Laid-Open No. 2010-014890 (See FIG. 4 thereof), a developer replenishment type process cartridge adopts the following construction:

The development unit is divided into a development portion and a developer storage portion. The development portion and the developer storage portion are connected to each other by openings provided at both ends in the rotational axis direction of the image bearing member (hereinafter referred to as the "longitudinal direction"). The developer storage portion is provided with a developer conveyance member for conveying the developer and a developer stirring member for stirring the developer. The developer is circulated within the development unit by the developer conveyance member and the developer stirring member, whereby the new and old developers are uniformly mixed with each other.

However, during transportation of the process cartridge, the developer in the developer storage portion may be pressed so as to be coagulated. In particular, when, during its transportation, the process cartridge is caused to assume an attitude in which the longitudinal direction thereof oriented in the vertical direction, with the downstream side in the conveyance direction of the developer conveyance member being at the bottom, the coagulated developer is gathered on the downstream side in the conveyance direction of the developer conveyance member. When the process cartridge is used in this state, the coagulated developer is further pressed and hardened by the developer conveyance member, so that there is the possibility of the requisite torque for driving the developer conveyance member being increased.

As a countermeasure against this problem, Japanese Patent Application Laid-Open No. 11-160985 (See FIG. 1 thereof) discusses a construction in which a clutch is provided in a drive gear row of the developer stirring member and the developer conveyance member. In the case where the developer stirring member and the developer conveyance member are driven by the same drive source, when an excessive load is applied to the drive source, the rotation of the developer conveyance member is stopped by the clutch, and only the developer stirring member is allowed to rotate.

Further, as discussed in Japanese Patent Application Laid-Open No. 2009-116039 (See FIG. 1 thereof), a construction is available in which a torque limiter is connected to a drive gear of the developer stirring member and in which, when an excessive load is applied, the driving of the developer stirring member is interrupted, with rotation being only allowed for toner seal pulling.

However, as discussed in Japanese Patent Application Laid-Open No. 11-160985 and Japanese Patent Application Laid-Open No. 2009-116039, in the case where a clutch or the like is provided in the drive gear row of the developer stirring member and the developer conveyance member, there is a fear of the apparatus being increased in size due to the provision of the clutch.

It might be possible to arrange the clutch within the developer storage portion in order to avoid an increase in apparatus size. However, when the clutch is arranged within the developer storage portion, the portion of the developer around the clutch is not conveyed by the developer conveyance member, so that there is the possibility of some developer being allowed to stay around the clutch.

SUMMARY OF THE INVENTION

The present specification is directed to a reduction in the size of the developer conveyance apparatus through the arrangement inside the developer storage portion of a mechanism configured to stop or decelerate the rotation of the developer conveyance portion (hereinafter referred to as the clutch).

According to an aspect of the present disclosure, a developer conveyance apparatus for use in an image forming apparatus includes a developer storage portion configured to store developer, a developer conveyance portion arranged inside the developer storage portion and configured to convey the developer through rotation along a rotation axis thereof, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and is provided on an upstream side of the developer conveyance portion in a developer conveyance direction in which the developer conveyance portion coveys the developer.

According to another aspect of the present disclosure, a developer conveyance apparatus for use in an image forming apparatus includes a developer storage portion configured to store developer, a developer conveyance portion arranged inside the developer storage portion and configured to convey the developer through rotation, a drive input portion configured to input a drive force to the developer conveyance portion, and a clutch arranged inside the developer storage portion and configured to transmit the drive force from the drive input portion to the developer conveyance portion, the clutch stopping or decelerating the rotation of the developer conveyance portion when a requisite torque for rotating the developer conveyance portion exceeds a predetermined magnitude, wherein the clutch includes a moving member movable to a drive transmission position to transmit a drive force to the developer conveyance portion to rotate the developer conveyance portion and to a non-transmission position to stop or decelerate a rotation of the developer conveyance portion, and wherein the moving member is provided with a through-hole allowing passage of the developer.

According to yet another aspect as disclosed herein, a developer conveyance apparatus for use in an image forming apparatus includes a developer storage portion configured to store developer, a developer conveyance portion arranged inside the developer storage portion and configured to convey the developer through rotation, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and includes at least one clutch side conveyance portion which, when receiving the drive force from the drive input portion, conveys the developer in a developer conveyance direction in which the developer conveyance portion conveys the developer.

According to yet another aspect of the present disclosure, a process cartridge detachably attachable to an apparatus main body of an image forming apparatus includes an image bearing member on which a latent image is formed, a developer bearing member configured to develop the latent image by using developer, a developer storage portion configured to store developer to be borne by the developer bearing member, a developer conveyance portion arranged inside the developer storage portion and configured to convey the developer through rotation along a rotation axis thereof, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and is provided on an upstream side of the developer conveyance portion in a developer conveyance direction in which the developer conveyance portion coveys the developer.

According to yet another aspect of the present disclosure, a process cartridge detachably attachable to an apparatus main body of an image forming apparatus includes an image bearing member on which a latent image is formed, a developer bearing member configured to develop the latent image by using developer, a developer storage portion configured to store developer to be borne by the developer bearing member, a developer conveyance portion arranged inside the developer storage portion and configured to convey the developer through rotation, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and includes a moving member movable to a drive transmission position to transmit a drive force to the developer conveyance portion to rotate the developer conveyance portion and to a non-transmission position to stop or decelerate the rotation of the developer conveyance portion, and wherein the moving member is provided with a through-hole allowing passage of the developer.

According to yet another aspect as disclosed herein, a process cartridge detachably attachable to an apparatus main body of an image forming apparatus includes an image bearing member on which a latent image is formed, a developer bearing member configured to develop the latent image by using developer, a developer storage portion configured to store developer to be borne by the developer bearing member, a developer conveyance portion arranged inside the developer storage portion and configured to convey the developer through rotation, a drive input portion configured to input a drive force to the developer conveyance portion, and a clutch arranged inside the developer storage portion and configured to transmit the drive force from the drive input portion to the developer conveyance portion, the clutch stopping or decelerating a rotation of the developer conveyance portion when a requisite torque for rotating the developer conveyance portion exceeds a predetermined magnitude, wherein the clutch is arranged inside the developer storage portion and includes at least one clutch side conveyance portion which, when receiving the drive force from the drive input portion, conveys the developer in a developer conveyance direction in which the developer conveyance portion conveys the developer.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the ideas and concepts disclosed herein and, together with the description, serve to explain the principles of the disclosure.

DESCRIPTION OF THE EMBODIMENTS

Various exemplary embodiments, features, and aspects of the invention will be described in detail below with reference to the drawings.

In the following, a developer conveyance apparatus according an exemplary embodiment of the present disclosure and a process cartridge type color image forming apparatus adopting the same will be described with reference to the drawings.

Figure 2:
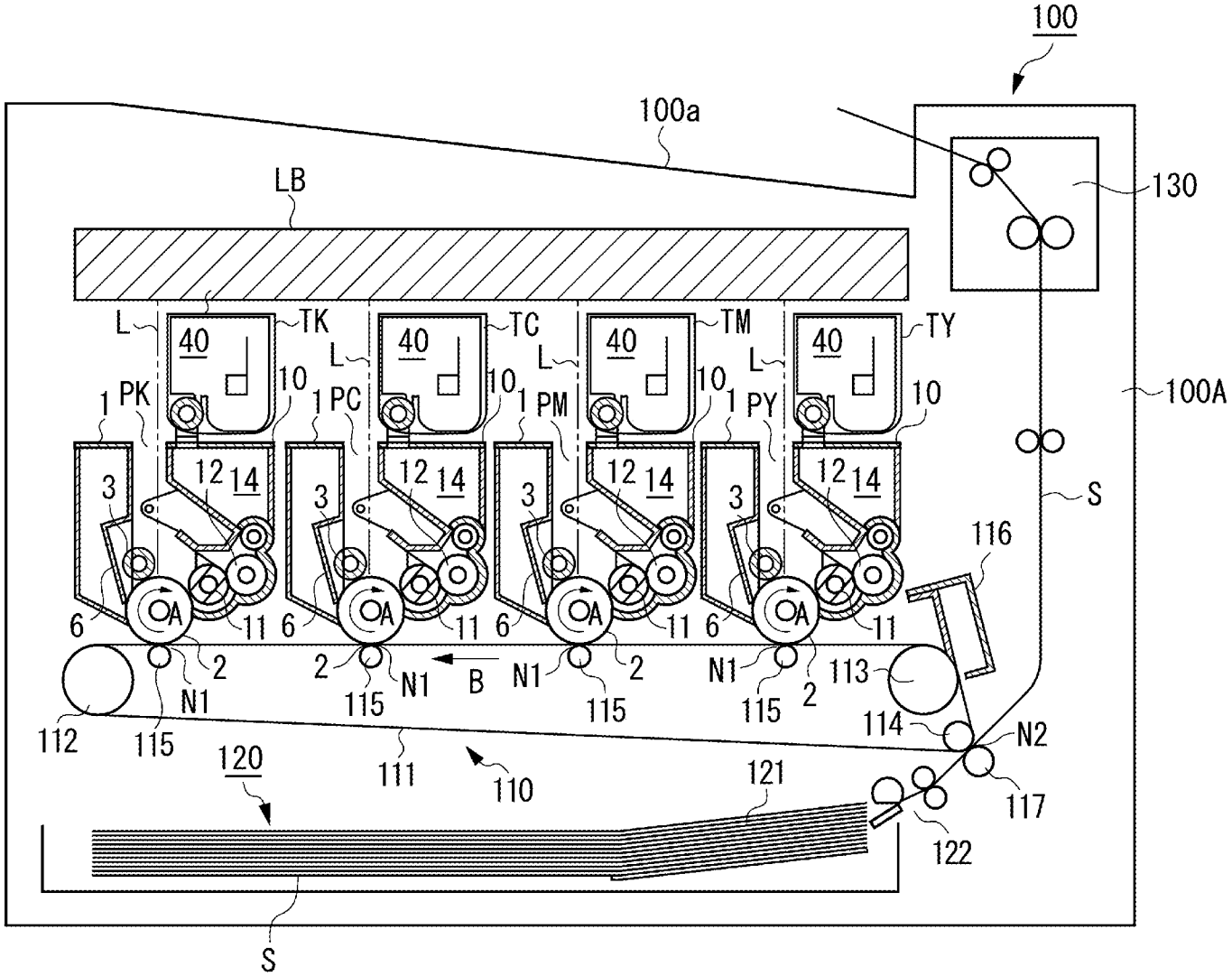
FIG. 2 is a schematic sectional view of an electrophotographic image forming apparatus according to first through third exemplary embodiments.
Figure 3:
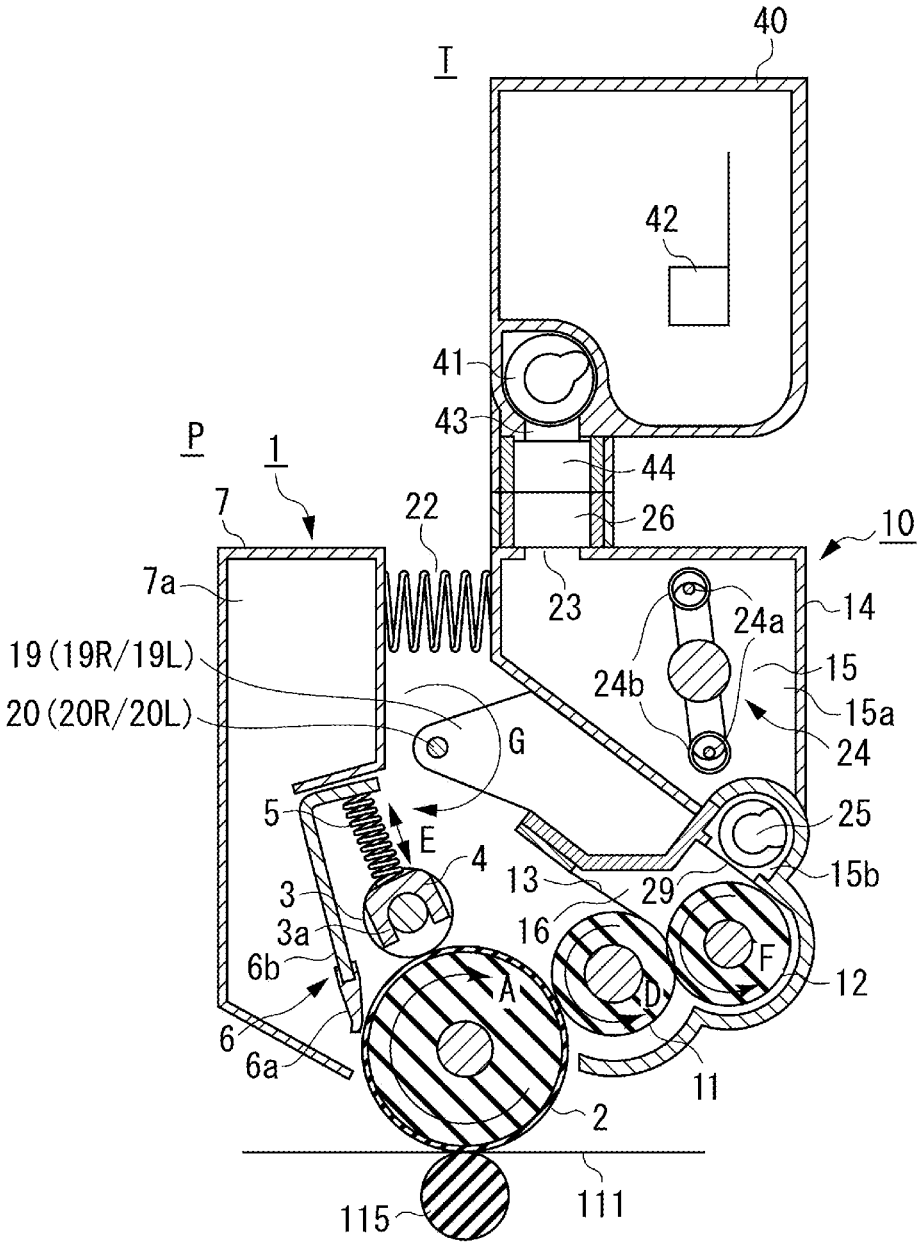
FIG. 3 is a main sectional view of a process cartridge and a developer replenishment cartridge according to the first through third exemplary embodiments.

First, the general construction of an image forming apparatus according to the first exemplary embodiment will be described with reference to FIGS. 2 and 3. FIG. 2 is a schematic sectional view illustrating a color electrophotographic image forming apparatus. FIG. 3 is a main sectional view of a process cartridge and a developer replenishment cartridge.

The image forming apparatus 100 illustrated in FIG. 2 is a four-full-color laser printer employing the electrophotographic process, and is configured to perform color image formation on a recording medium S. The image forming apparatus 100 adopts the process cartridge system. In this system, a process cartridge P and a developer replenishment cartridge T are detachably attached to an image forming apparatus main body 100A, and a color image is formed on the recording medium S.

In the following description, the image forming apparatus main body (hereinafter referred to as the "apparatus main body") 100A refers to the apparatus portion obtained by excluding the process cartridge P and the developer replenishment cartridge T from the image forming apparatus 100.

In the apparatus main body 100A, there are horizontally arranged first through fourth process cartridges P (PY, PM, PC, and PK) and developer replenishment cartridges T (TY, TM, TC, and TK). The process cartridges P and the developer replenishment cartridges T respectively exhibit electrophotographic process mechanisms similar to each other, and they differ from each other in the color of the developer and in the amount of developer charged therein. A rotational drive force is transmitted from the apparatus main body 100A to the process cartridges P and to the developer replenishment cartridges T. Further, a bias (charging bias, development bias or the like) is supplied to the process cartridges P from the apparatus main body 100A. The process cartridges P and the developer replenishment cartridges T are independently detachably attachable to the apparatus main body 100A.

As illustrated in FIG. 3, each process cartridge P according to the present exemplary embodiment is formed by a cleaning unit 1 and a development unit 10. The cleaning unit 1 is equipped with a photosensitive drum 2 constituting the image bearing member, a charging roller 3 acting on the photosensitive drum 2, and a cleaning member 6. The development unit 10 has a development portion for developing an electrostatic latent image on the photosensitive drum 2. The cleaning unit 1 and the development unit 10 are swingably connected to each other.

The first process cartridge PY stores yellow (Y) developer inside the developer storage portion 15, forming a yellow developer image on the photosensitive drum 2. Similarly, the second process cartridge PM stores magenta (M) developer, the third process cartridge PC stores cyan (C) developer, and the fourth process cartridge PK stores black (K) developer.

On the other hand, the first developer replenishment cartridge TY stores yellow (Y) developer in a replenishment frame body 40, replenishing the process cartridge PY storing developer of the same color with yellow developer. Similarly, the second developer replenishment cartridge TM stores magenta (M) developer, replenishing the process cartridge PM storing developer of the same color with magenta developer. Similarly, the third developer replenishment cartridge TC stores cyan (C) developer, replenishing the process cartridge PC storing developer of the same color with cyan developer. Similarly, the fourth developer replenishment cartridge TK stores black (K) developer, replenishing the process cartridge PK storing developer of the same color with black developer.

As illustrated in FIG. 3, the replenishment frame body 40 of the developer replenishment cartridge T is provided with a developer replenishment opening 43 for replenishing the process cartridge P with developer. The developer storage portion 15 of the process cartridge P is provided with a developer reception port 23 corresponding to the developer replenishment opening 43. When the process cartridge P and the developer replenishment cartridge T are attached to the apparatus main body 100A, the developer replenishment opening 43 and the developer reception port 23 communicate with each other, and developer is supplied from the developer replenishment cartridge T to the process cartridge P.

The process cartridge P and the developer replenishment cartridge T will be described in detail below.

As illustrated in FIG. 2, above the process cartridges P (PY, PM, PC, and PK), there is arranged a laser scanner unit LB as an exposure unit. The laser scanner unit LB outputs a laser beam L corresponding to image information. Scanning and exposure are performed on the surface of the photosensitive drum 2 with the laser beam L.

Under the process cartridges P (PY, PM, PC, and PK), there is arranged an intermediate transfer belt unit 110 as a primary transfer member. The intermediate transfer belt unit 110 includes a flexible endless transfer belt 111, and a driving roller 112, a driven roller 113, and a secondary transfer opposing roller 114, between which the transfer belt 111 is stretched for rotation. The photosensitive drums 2 of the process cartridges P are in contact with the transfer belt 111. Contact portions N1 between the photosensitive drums 2 and the transfer belt 111 constitute primary transfer units. On the inner side of the transfer belt 111, there are arranged primary transfer rollers 115 so as to be opposite the photosensitive drums 2. At the position opposite the secondary transfer opposing roller 114, there is arranged a secondary transfer roller 117 as a secondary transfer unit. A contact portion N2 between the transfer belt 111 and the secondary transfer roller 117 constitutes a secondary transfer unit.

Under the intermediate transfer belt unit 110, there is arranged a feeding unit 120. The feeding unit 120 is a recording medium conveyance portion configured to convey the recording medium S, and includes a feeding tray 121 storing the recording medium S, and a feeding roller 122.

In the upper portion of the interior of the apparatus main body 100A, there is arranged a fixing unit 130. The upper surface of the apparatus main body 100A constitutes a discharge tray 100*a*.

Next, a full color image forming operation will be described with reference to FIG. 2. FIG. 2 is a schematic sectional view of a color electrophotographic image forming apparatus.

The full color image forming operation is as follows:

The photosensitive drums 2 of the first through fourth cartridges P (PY, PM, PC, and PK) are rotated in the direction of the arrow A of FIG. 2 at a predetermined speed. The transfer belt 111 is rotated in the direction of the arrow B (the forward direction with respect to the rotation of the photosensitive drums). At this time, the speed of the transfer belt 111 corresponds to the speed of the photosensitive drums 2. At the same time, the laser scanner unit LB is driven.

In synchronism with the driving of the laser scanner unit LB, the charging rollers 3 of the cartridges P uniformly charge the surfaces of the photosensitive drums 2 at a predetermined polarity and potential. The laser scanner unit LB performs scanning and exposure on the surface of each photosensitive drum 2 with the laser beam L corresponding to an image signal for each color. As a result, an electrostatic latent image corresponding to the image signal of the corresponding color is formed on the surface of each photosensitive drum 2. The electrostatic latent images are developed by development rollers 11. The development rollers 11 are developer bearing members, and are configured to carry the developer with which the latent images formed on the photosensitive drums 2 as the image bearing members are to be developed.

Through the above image forming operation, a yellow developer image is formed on the photosensitive drum 2 of the first cartridge PY. Then, the yellow developer image undergoes primary transfer onto the transfer belt 111. Similarly, the developer images of the second cartridge PM, the third cartridge PC, and the fourth cartridge PK are superimposed one upon the other on the transfer belt 111, whereby there is formed an unfixed full-four-color developer image. In each process cartridge P, the developer remaining on the surface of the photosensitive drum 2 after the first transfer is removed by the cleaning member 6. On the other hand, the recording medium S stored in the feeding tray 121 is fed with predetermined control timing. The full four-color developer image on the transfer belt 111 is collectively transferred onto the surface of the recording medium S introduced into the secondary transfer unit N2.

The recording medium S is separated from the surface of the transfer belt 111, and is introduced into the fixing unit 130. Then, the recording medium S is subjected to heating and pressurization at a fixing nip portion. As a result, the developer image is fixed to the recording medium. After this, the recording medium S which has undergone fixing is conveyed onto the discharge tray 100*a*, whereby the full-color image forming operation is completed.

Figure 4:
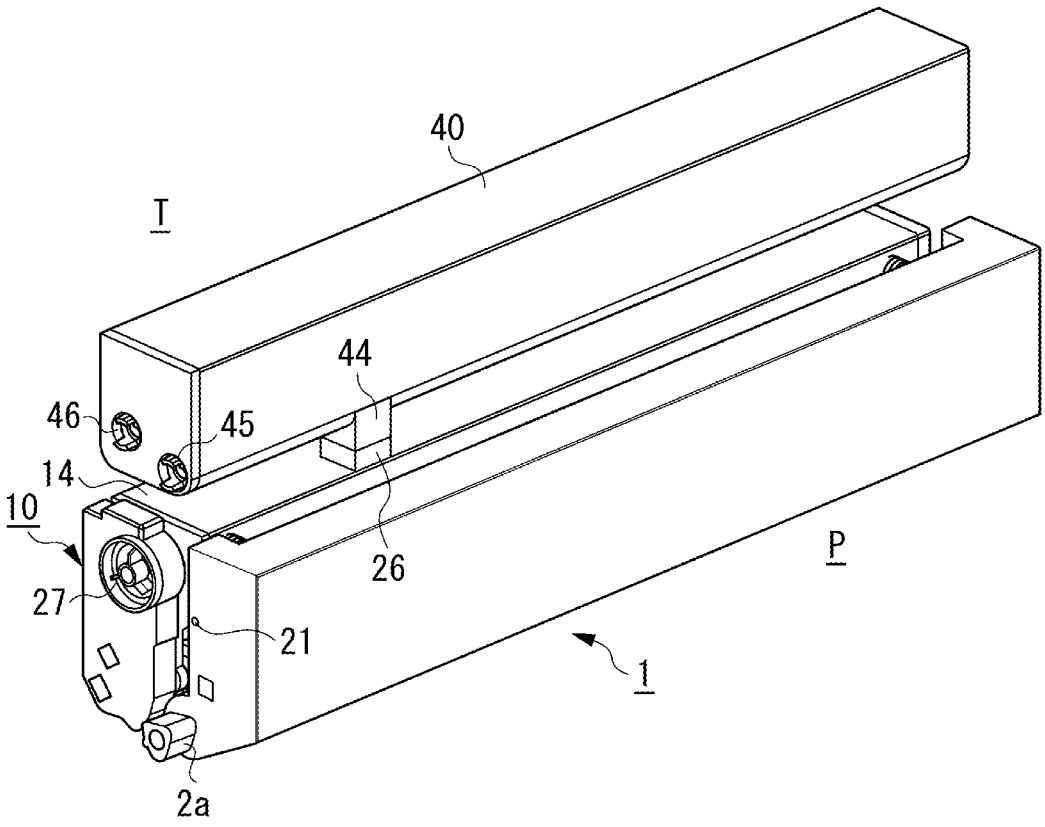
FIG. 4 is a general perspective view of a process cartridge and a developer replenishment cartridge in the image forming apparatus according to the first through third exemplary embodiments.
Figure 5:
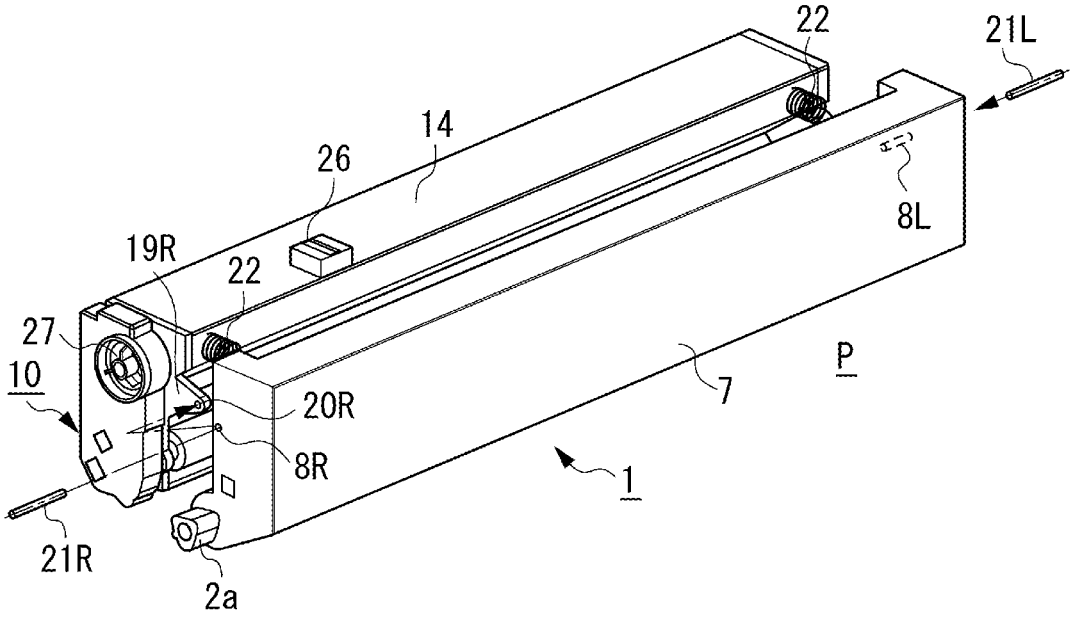
FIG. 5 is a general exploded perspective view of the process cartridge according to the first through third exemplary embodiments.

Next, the general construction of the process cartridge P will be described with reference to FIGS. 3, 4, and 5. FIG. 3 is a main portion sectional view of the process cartridge and of the developer replenishment cartridge. FIG. 4 is a general perspective view of the process cartridge P and the developer replenishment cartridge T inside the image forming apparatus. FIG. 5 is a general perspective view of the process cartridge.

As illustrated in FIG. 3, the process cartridge P (PY, PM, PC, PK) is formed by a cleaning unit 1 and a development unit 10.

First, the cleaning unit 1 will be described. The cleaning unit 1 includes a cleaning frame body 7, the photosensitive drum 2, the charging roller 3, and the cleaning member 6.

The photosensitive drum 2 is rotatably supported by the cleaning frame body 7. As illustrated in FIG. 4, at one end of the photosensitive drum 2, there is provided a drum drive coupling 2*a*. The photosensitive drum 2 and the drum drive coupling 2*a* are formed integrally. The drum drive coupling 2*a* is configured to be engaged with a coupling (not illustrated) of the apparatus main body 100A. The drive force of a drive motor (not illustrated) of the apparatus main body is transmitted to the drum drive coupling 2*a*, whereby the photosensitive drum 2 is rotated in the direction of the arrow A at a predetermined speed.

The charging roller 3 is configured to be driven to rotate while being held in contact with the photosensitive drum 2. As illustrated in FIG. 3, the charging roller 3 is mounted to the cleaning frame body 7 through the intermediation of a charging roller bearing 4. The charging roller 3 is mounted so as to be movable in the direction of the arrow E in FIG. 3 along the line connecting the rotation center of the charging roller 3 and the rotation center of the photosensitive drum 2. A rotation shaft 3*a* of the charging roller 3 is rotatably supported by the charging roller bearing 4. The charging roller bearing 4 is urged toward the photosensitive drum 2 by a charging roller pressurization member 5.

The cleaning member 6 is composed of an elastic rubber blade 6*a* at the distal end and a support metal plate 6*b*. The distal end of the elastic rubber blade 6*a* is held in contact with the photosensitive drum 2 in a counter direction with respect to the rotating direction of the photosensitive drum 2 (the direction of the arrow A in FIG. 3). The cleaning member 6 removes the developer remaining on the photosensitive drum 2. The developer removed from the peripheral surface of the photosensitive drum 2 by the cleaning member 6 is stored in a removed developer storage portion 7*a* of the cleaning frame body 7.

Next, the development unit 10 will be described. As illustrated in FIG. 3, the development unit 10 includes a development frame body 14 supporting the various components inside the development unit 10. The inner space of the development frame body 14 is divided into a development portion (development chamber) 16 and a developer storage portion 15.

Provided inside the development portion 16 are a development roller 11, a developer supply roller (hereinafter referred to as the "supply roller") 12, and a development blade 13. The development roller 11 is configured to rotate in the direction of the arrow D while being in contact with the photosensitive drum 2. The supply roller 12 is configured to rotate in the direction of the arrow F while being in contact with the development roller 11. The supply roller 12 has two roles: first, it supplies developer onto the development roller 11. Second, it scrapes off any developer remaining on the development roller 11 without being used for development. The development blade 13 is held in contact with the peripheral surface of the development roller 11, thereby regulating the layer thickness of the developer on the development roller 11.

On the other hand, the developer storage portion 15 stores the developer supplied from the developer replenishment cartridge T. The developer storage portion 15 will be described in detail below.

Next, the connection between the cleaning unit 1 and the development unit 10 will be described. As illustrated in FIG. 5, the cleaning frame body 7 has cleaning connection holes (8R and 8L). As illustrated in FIG. 3, the development frame body 14 is provided with development side plates 19 (19R and 19L) on both sides in the longitudinal direction. The development side plates 19 (19R and 19L) have development connection holes 20 (20R and 20L). As illustrated in FIG. 5, the cleaning connection holes 8 (8R and 8L) and the development connection holes 20 (20R and 21L) are fit-engaged with connection shaft 21 (21R and 21L) for swingable connection. As a result, the cleaning unit 1 and the development unit 10 are connected to each other.

As illustrated in FIG. 5, between the cleaning unit 1 and the development unit 10, there are arranged pressurization springs 22 at both ends. The urging force of the pressurization spring 22 provides a rotational moment in the direction of the arrow G around the development connection holes 20. As a result, the development roller 11 is held in contact with the photosensitive drum 2.

While in the present exemplary embodiment the development roller 11 is arranged so as to be in contact with the photosensitive drum 2, it is also possible for these components to be arranged at a predetermined interval from each other.

Figure 6:
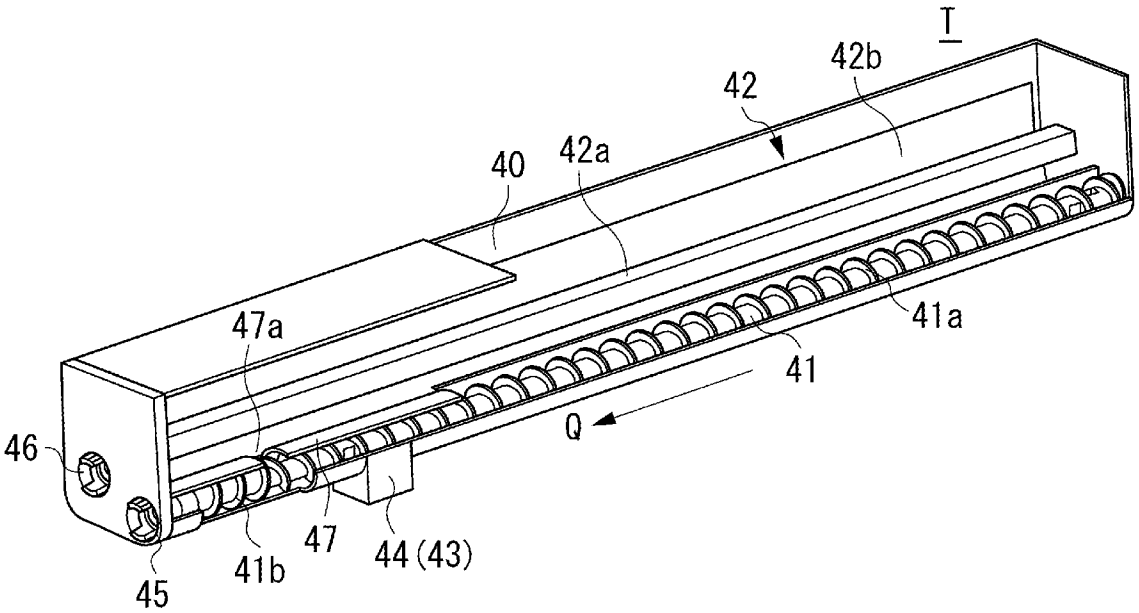
FIG. 6 is a schematic perspective view of the developer replenishment cartridge according to the first through third exemplary embodiments.

Next, the construction of the developer replenishment cartridge T will be described with reference to FIGS. 3 and 6. FIG. 3 is a main portion sectional view of the process cartridge P and the developer replenishment cartridge T. FIG. 6 is a schematic perspective view illustrating the construction of the developer replenishment cartridge T.

As illustrated in FIG. 3, the developer replenishment cartridge T has a replenishment frame body 40 for storing developer. The replenishment frame body 40 has a developer replenishment opening 43 for replenishing the process cartridge P with developer. Under the developer replenishment opening 43, there is provided a developer replenishment shutter 44. The developer replenishment shutter 44, which is normally closed, is configured to be opened in the state in which the process cartridge P and the developer replenishment cartridge T have been attached to the apparatus main body 100A.

Inside the replenishment frame body 40, there are provided a replenishment conveyance ember 41 and a replenishment stirring member 42. The replenishment conveyance member 41 and the replenishment stirring member 42 are rotatably supported by the replenishment frame body 40. The replenishment conveyance member 41 conveys the developer inside the replenishment frame body 40 toward the developer replenishment opening 43. As illustrated in FIG. 6, the replenishment conveyance member 41 is a screw member having on its surface a spiral fin 41*a* and a return fin 41*b*. The fin 41*a* conveys developer in the direction of the arrow Q. The return fin 41*b* conveys developer in a direction reverse to that of the fin 41*a*. A cover member 47 is provided above the replenishment conveyance member 41. The cover member 47 longitudinally covers apart of the developer replenishment opening 43 and the replenishment conveyance member 41. The cover member 47 is provided with a return hole 47*a*.

On the other hand, the replenishment stirring member 42 serves two purposes: first, it stirs the developer inside the replenishment frame body 40. Second, it conveys the stirred developer to the replenishment conveyance member 41. The replenishment stirring member 42 is formed by a replenishment stirrer 42*a* and a replenishment stirring sheet 42*b*.

At one longitudinal end of the replenishment conveyance member 41 and the replenishment stirring member 42, there are respectively provided a replenishment conveyance coupling 45 and a replenishment stirring coupling 46. The replenishment conveyance coupling 45 and the replenishment stirring coupling 46 are engaged with a coupling (not illustrated) of the apparatus main body 100A. The drive force of a drive motor (not illustrated) of the apparatus main body 100A is transmitted to the replenishment conveyance coupling 45 and the replenishment stirring coupling 46, whereby the replenishment conveyance member 41 and the replenishment stirring member 42 are rotated at a predetermined speed.

The conveyance of the developer inside the developer replenishment cartridge T will be described. The developer inside the replenishment frame body 40 is stirred by the replenishment stirring member 42, and is sent to the replenishment conveyance member 41. When it has been conveyed to the cover member 47, the developer sent to the replenishment conveyance member 41 is partially regulated by the cover member 47. As a result, the amount of developer discharged from the developer replenishment opening 43 becomes constant. The developer conveyed into the cover member 47 is discharged to the process cartridge P from the developer replenishment opening 43. The portion of the developer which has not been dropped from the developer replenishment opening 43 is sent to the replenishment stirring member 42 from the return hole 47*a* by the return fin 41*b*, and is stirred again.

Figure 7A:
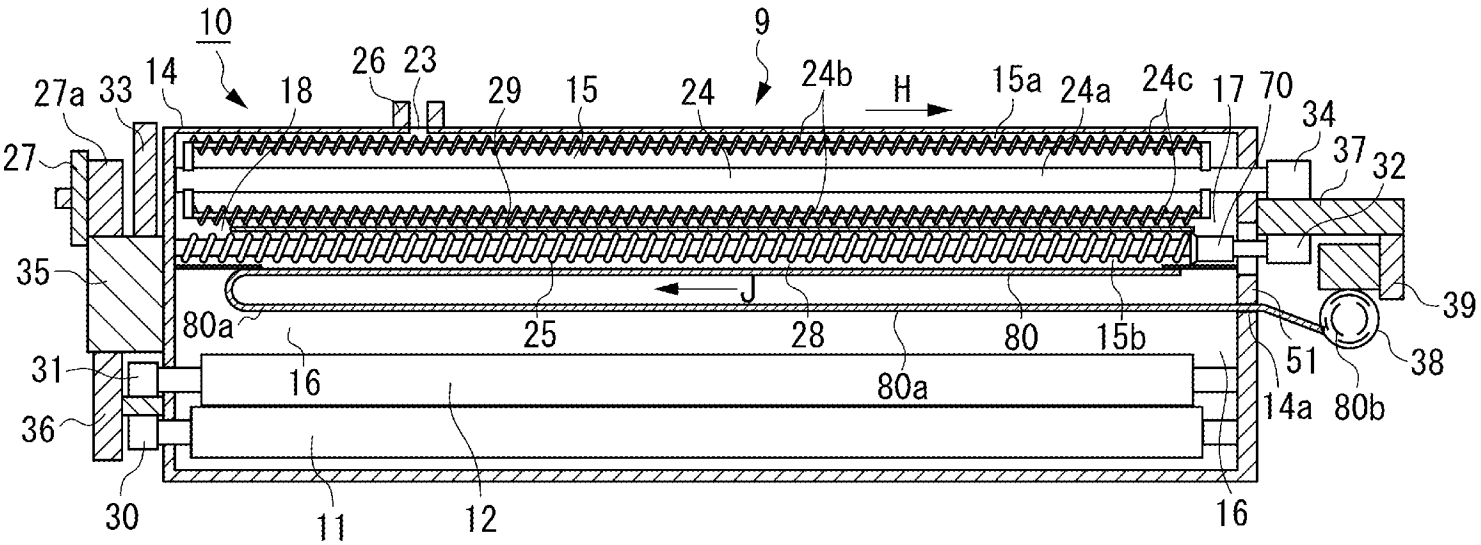
FIGS. 7A and 7B are schematic sectional views of a development unit according to the first through third exemplary embodiments.
Figure 7B:
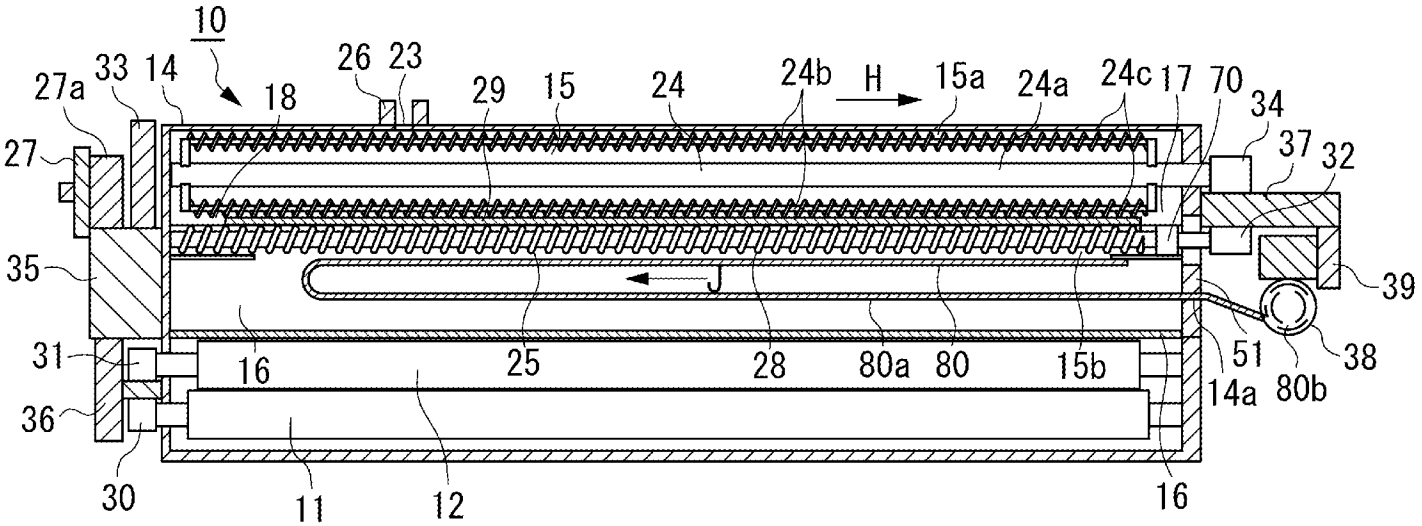

Next, the construction of a developer conveyance portion (developer conveyance apparatus) 9 used in the image forming apparatus 100 will be described with reference to FIGS. 7A and 7B. FIGS. 7A and 7B are schematic sectional views illustrating the construction of the development unit 10.

In the present exemplary embodiment, the developer conveyance apparatus 9 is formed by members such as a developer storage portion 15 provided in the development unit 10 and a developer conveyance member 25 mounted to the developer storage portion 15.

As illustrated in FIGS. 7A and 7B, the developer storage portion 15 is divided into a second storage portion 15*a* and a first storage portion 15*b* by a partition portion 29. The second storage portion 15*a* and the first storage portion 15*b* are connected to each other by a first opening 17 and a second opening 18 provided at both longitudinal ends.

The second storage portion 15*a* is provided with a developer reception port 23. The developer reception port 23 is connected to the developer replenishment opening 43 of the developer replenishment cartridge T. Through the connection between the developer replenishment opening 43 and the developer reception port 23, developer is supplied from the developer replenishment cartridge T to the process cartridge P. Above the developer reception port 23, there is arranged a developer reception shutter 26. Normally, the developer reception shutter 26 is closed. It is configured to be opened in the state in which the process cartridge P and the developer replenishment cartridge T have been attached to the apparatus main body 100A.

The first storage portion 15*b* is connected to the development portion 16 via a development opening (opening) 28. In the state in which the process cartridge P is unused, the development opening 28 is sealed by a sealing member 80. Here, the development opening 28 is an opening for discharging developer from the developer storage portion 15. The sealing member 80 is mounted to this development opening 28, and helps to prevent leakage of developer from the developer storage portion 15 during transportation of the process cartridge P. The sealing member 80 is bonded to the surface of the development opening 28 by fusion bonding or the like.

As illustrated in FIGS. 7A and 7B, one longitudinal end of the sealing member 80 is folded back, and passes through a seal opening 14*a* provided in the development frame body 14, extending to the exterior of the development frame body 14. The seal opening 14*a* is provided with a seal member 51. The seal member 51 prevents leakage of developer through the seal opening 14*a*. A longitudinal end portion 80*b* of a folded-back portion 80*a* of the sealing member 80 is connected to a take-up member 38 outside the development frame body 14. The sealing member 80 is bonded to a take-up shaft portion 38*b* by a double-faced tape or the like. When using the process cartridge P, the sealing member 80 is removed by being taken up by the take-up member 38. The take-up member 38 is a removing member for detaching (removing) the sealing member 80 from the development opening 28.

The second storage portion 15*a* is provided with a developer stirring member 24. The developer stirring member 24 serve two purposes: first, it mixes the developer inside the developer storage portion with the developer supplied from the developer replenishment cartridge T. Second, it conveys the developers thus mixed with each other in the direction of the arrow H. That is, assuming that the developer conveyance member 25 is a first developer conveyance member, the developer stirring member is a second developer conveyance member. This developer stirring member 24 is formed by mounting a stirring spring 24*c* to a development support shaft 24*b* provided around the development stirring shaft 24*a*.

The first storage portion 15*b* is provided with the developer conveyance member 25. The developer conveyance member 25 is a screw member configured to convey developer in the direction of the arrow J (the developer conveyance direction). The direction of the arrow J is a direction reverse to the direction (the direction of the arrow H) in which the developer moves within the second storage portion 15*a*. At this time, the speed at which the developer is conveyed by the developer stirring member 24 provided in the second storage portion 15*a* (the speed at which the developer moves within the second storage portion 15*a*) is set slower than the speed at which the developer is conveyed by the developer conveyance member 25 (the speed at which the developer moves within the first storage portion 15*b*).

The conveyance of the developer within the development unit 10 will be described. Inside the second storage portion 15*a*, the developer supplied from the developer replenishment cartridge T is mixed with the developer within the developer storage portion 15 by the developer stirring member 24. The resultant mixture of developer is sent to the first storage portion 15*a* via the first opening 17. In the first storage portion 15*b*, the developer is conveyed (supplied) from the development opening 28 to the development portion 16 by the developer conveyance member 25. The developer conveyed by the development portion 16 is sent to the development roller 11 via the supply roller 12 and is developed. The portion of the developer which has not been used for development returns from the development portion 16 to the first storage portion 15*b* again. After this, it is conveyed from the second opening 18 to the second storage portion 15*a* by the developer conveyance member 25. By repeating this, the developer is circulated.

Next, the drive construction of the development unit will be described with reference to FIGS. 5, 7A, and 7B. FIG. 5 is a general perspective view of the process cartridge P. FIGS. 7A and 7B are schematic sectional views of the development unit.

As illustrated in FIGS. 7A and 7B, at one end of the development roller 11, there is provided a development roller gear 30 for transmitting drive to the development roller 11. At one end of the supply roller 12, there is provided a supply roller gear 31 for transmitting drive to the supply roller 12. At one end of the developer conveyance member 25, there is provided a conveyance member gear 32 for transmitting drive to the developer conveyance member 25. The conveyance member gear 32 is a drive input portion for inputting a drive force (rotational force) to the developer conveyance member 25.

At one end of the developer stirring member 24, there is provided a first developer stirring gear 33 for transmitting drive to the developer stirring member 24. At the other end of the developer stirring member 24, there is provided a second developer stirring gear 34 for transmitting drive from the developer stirring member 24.

On the other hand, as illustrated in FIG. 5, at one longitudinal end of the development unit 10, there is provided a development drive coupling 27. The development drive coupling 27 is engaged with a coupling (not illustrated) of the apparatus main body 100A. When the drive force of a drive motor (not illustrated) of the apparatus main body 100A is transmitted thereto, the development drive coupling 27 rotates at a predetermined speed.

The drive force of the apparatus main body 100A is transmitted from the development drive coupling 27 by the following route:

As illustrated in FIGS. 7A and 7B, the drive of the development drive coupling 27 is transmitted from a gear portion 27*a* of the development drive coupling 27 to a development roller gear 30 and a supply roller gear 31 via a first idler gear 35 and a second idler gear 36. As a result, the development roller 11 and the supply roller 12 are driven.

Further, the drive of the first idler gear 35 is also transmitted to the first development stirring gear 33, driving the developer stirring member 24. The drive of the developer stirring member 24 is transmitted to the conveyance member gear 32 from the second developer stirring gear 34 via a third idler gear 37, driving the developer conveyance member 25.

Further, the drive of the third idler gear 37 is also transmitted to a fourth idler gear 39. The drive of the fourth idler gear is transmitted to the take-up member 38, causing the take-up member 38 to rotate. As a result, the sealing member 80 is taken up, and is removed from the development opening 28.

When the process cartridge P is attached to the apparatus main body 100A, and is detected to be new, the development drive coupling 27 is driven, whereby the taking-up of the sealing member 80 is started.

At this time, applied to the development drive coupling 27 is the requisite load torque (rotational load) for driving the development roller 11, the supply roller 12, the developer stirring member 24, the developer conveyance member 25, and the take-up member 38 for the sealing member 80.

In particular, as is known in the art, when, as a result of transportation, the developer is coagulated on the downstream side with respect to the developer conveyance direction J in which developer is conveyed by the developer conveyance member 25 in the first storage portion 15*b*, and on the upstream side with respect to the developer conveyance direction H in which developer is conveyed by the developer stirring member 24 in the second storage portion 15*a*, the load torque is maximum. The reason for this is that when the driving of the developer conveyance member 25 and of the developer stirring member 24 is started, the speed of the developer moving inside the second storage portion 15*a* is slower than the speed of the developer moving inside the first storage portion 15*b*. As a result, the developer that is conveyed from the first storage portion 15*b* to the second storage portion 15*a* via the second opening 18 becomes liable to clog on the downstream side in the developer conveyance direction J. If, even after the clogging of the developer, the developer conveyance member 25 continues to be driven, the requisite load torque for driving the developer conveyance member 25 will be increased.

On the other hand, when the developer is coagulated on the downstream side in the developer conveyance direction J in which the developer is conveyed by the developer conveyance member 25, such a problem is rarely involved. This is due to the fact that the developer moving speed in the second storage portion 15*a* is higher than the developer moving speed in the first storage portion 15*b*, and that the coagulation of developer is eliminated owing to a space on the downstream side in the developer conveyance direction J in the first storage portion 15*b*.

Thus, as compared with the case where the developer is coagulated on the downstream side in the developer conveyance direction J, the load torque of the developer conveyance member 25 is smaller in the case where the developer is coagulated on the upstream side in the developer conveyance direction J.

In the developer conveyance apparatus 9 according to the present exemplary embodiment, as a countermeasure against the coagulation of developer on the downstream side in the developer conveyance direction J, there is provided a torque limiter (hereinafter referred to as the clutch portion) 70 inside the first storage portion 15*b* for the developer conveyance member 25 under the maximum load torque. This clutch portion 70 is provided inside the developer storage portion 15 so as to be between the developer conveyance member 25 and the conveyance member gear 32 and as to be coaxial with the developer conveyance member 25 and with the conveyance member gear 32. In this way, the clutch portion 70 is provided inside the developer storage portion 15, whereby it is possible to achieve a reduction in apparatus size as compared with the case where the clutch portion is provided outside the developer storage portion 15.

In the case where the requisite torque for rotating the developer conveyance member 25 has become a fixed level or more, the clutch portion 70 operates, and the drive force transmitted to the developer conveyance member 25 is cut off, with the rotation of the developer conveyance member 25 being stopped. Even while the driving of the developer conveyance member 25 is being interrupted, the transmission of drive to the fourth idler gear 39 is conducted, so that the taking-up of the sealing member 80 is continued. As the sealing member 80 is taken up, the development opening 28 gradually begins to be exposed. After this, the developer coagulated in the second storage portion 15*a* begins to drop upon the development portion 16. As a result of the dropping of the developer on the development portion 16, the load torque for driving the developer conveyance member 25 is reduced, and the drive of the conveyance member gear 32 is transmitted to the developer conveyance member 25, with the developer conveyance member 25 starting to be driven.

Further, also when the driving of the developer conveyance member 25 is interrupted, the developer stirring member 24 continues to be driven, so that it is possible to eliminate the coagulation of the developer also by the developer stirring member 24.

In the case where the developer is coagulated on the upstream side in the developer conveyance direction J in which the developer is conveyed by the developer conveyance member 25 in the first storage portion 15*b* of the developer storage portion and, at the same time, on the downstream side in the developer conveyance direction H in which the developer is conveyed by the developer stirring member 24 in the second storage portion 15*a*, the driving of the developer conveyance member 25 is not stopped.

As described above, the reason for this is that since the coagulated developer is conveyed while being loosened, the load torque of the developer conveyance member 25 is not increased so much. At this time, the clutch portion 70 does not operate.

Thus, it is when the developer is coagulated on the downstream side in the developer conveyance direction J that it is necessary to interrupt the driving of the developer conveyance member 25. At this time, on the upstream side in the developer conveyance direction J, where the clutch portion 70 is arranged, the developer is not coagulated, so that generation of operational defect of the clutch portion 70 due to the influence of the developer is suppressed.

Figure 1:
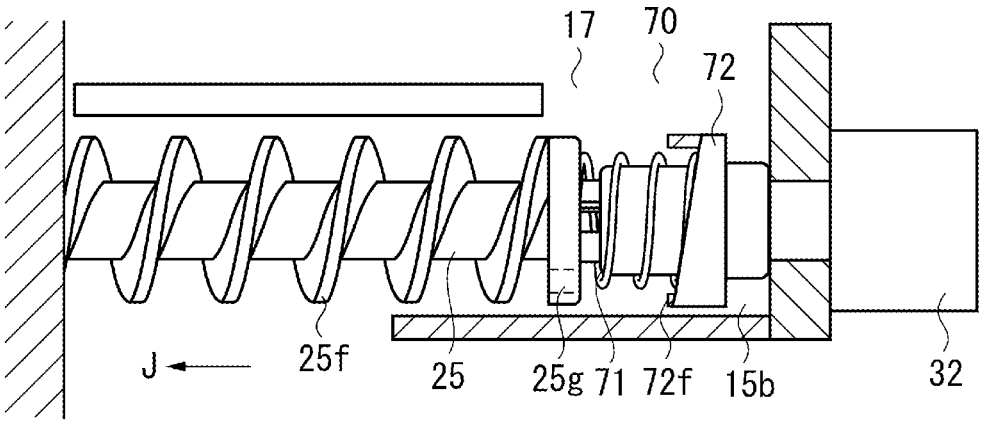
FIG. 1 is an enlarged view of a clutch portion according to a first exemplary embodiment.
Figure 8:
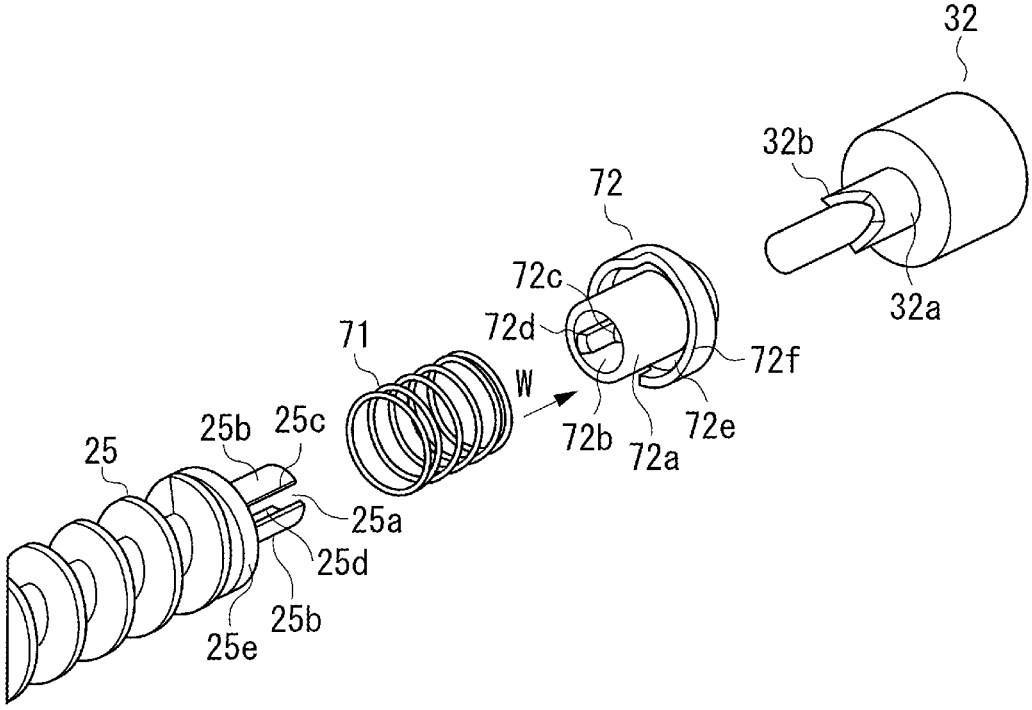
FIG. 8 is an exploded perspective view of the clutch portion according to the first exemplary embodiment.
Figure 9:
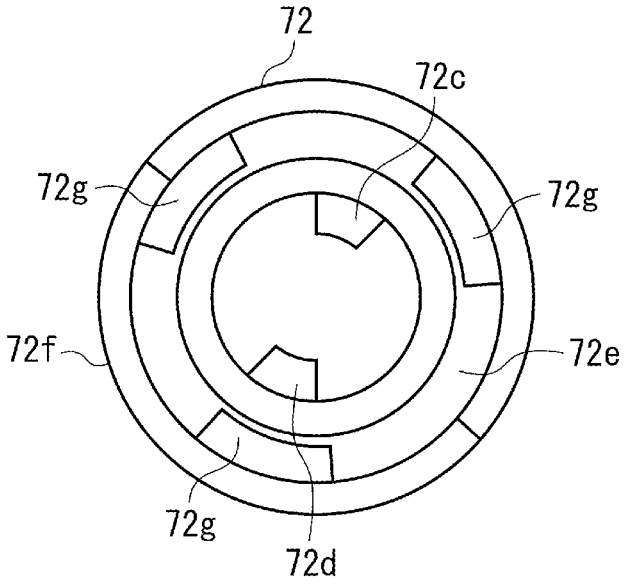
FIG. 9 is a diagram illustrating an engagement member according to the first exemplary embodiment as seen from the direction of the arrow W.
Figure 10A:
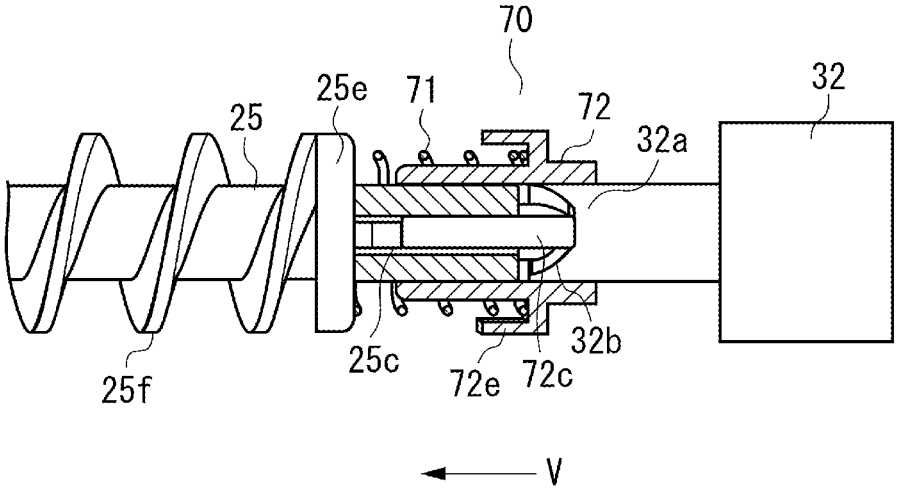
FIG. 10A is a diagram illustrating how the engagement member is engaged with a conveyance member gear.
Figure 10B:
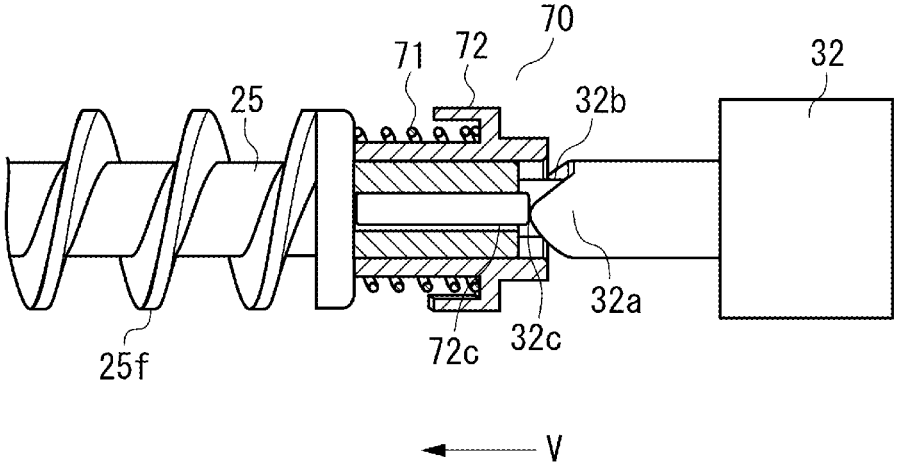
FIG. 10B is a diagram illustrating how the engagement member is out of engagement with the conveyance member gear.

The construction of the clutch portion 70 according to the present exemplary embodiment will be described in detail with reference to FIGS. 1, and 8 through 10. FIG. 1 is an enlarged view of the clutch portion 70 illustrated in FIGS. 7A and 7B. FIG. 8 is an exploded perspective view of the developer conveyance member 25 and of the clutch portion 70. FIG. 9 is a diagram illustrating an engagement member 72 as seen from the direction of the arrow W of FIG. 8. FIG. 10A is a schematic sectional view of the clutch portion 70 during the driving of the developer conveyance member 25. FIG. 10B is a schematic sectional view of the clutch portion 70 while the driving of the developer conveyance member 25 is interrupted.

As illustrated in FIG. 8, a compression coil spring (hereinafter referred to as the compression spring) 71, which is an elastic member, and an engagement member 72 are coaxially mounted to the developer conveyance member 25. In this state, the developer conveyance member 25 is mounted to the first storage portion 15*b* of the developer storage portion 15, and the conveyance member gear 32 is mounted from the outside of the developer frame body 14. At this time, the compression spring 71 is retained between a spring receiving surface 25*e* of the developer conveyance member 25 and a spring receiving portion 72*e* of the engagement member 72.

Further, an inner peripheral portion 72*b* of the engagement member 72 and an outer peripheral portion 32*a* of the conveyance member gear 32 are engaged with each other.

Next, the condition of the developer conveyance member 25 during driving will be described with reference to FIGS. 8 and 10A. The inner peripheral portion 72*b* of the engagement member 72 is provided with rib-like drive transmission portions 72*c* and 72*d*. The developer conveyance member 25 has a cylindrical portion 25*b*, and has slits at positions corresponding to the drive transmission portions 72*c* and 72*d*. The engagement member 72 is engaged with the cylindrical portion 25*b* such that the inner peripheral portion 72*b* is axially movable.

In order that the engagement member 72 may be movable with low load, the width of the slits 25*a* is made larger than the width of the drive transmission portions 72*c* and 72*d*.

The drive transmission portions 72*c* and 72*d* have the function of receiving the drive of the conveyance member gear 32 and transmitting the drive force to the developer conveyance member 25. Further, the conveyance member gear 32 has a slope 32*b* (hereinafter referred to as the cam surface) inclined with respect to the rotation axis of the developer conveyance member 25 and configured to be engaged with the engagement member 72. The cam surface 32*b* of the conveyance member gear 32 comes into contact with the drive transmission portions 72*c* and 72*d*, thereby transmitting a drive force to the engagement member 72. After this, the drive transmission portions 72*c* and 72*d* come into contact with drive-transmitted surfaces 25*c* and 25*d* while being in contact with the slits 25*a* of the developer conveyance member 25, whereby the developer conveyance member 25 is driven.

Next, the condition while the driving of the developer conveyance member is interrupted will be described with reference to FIGS. 8 and 10B.

When the requisite load torque for driving the developer conveyance member 25 attains a fixed level or more, the drive transmission portions 72*c* and 72*d* of the engagement member 72 move along the cam surface 32*b* of the rotating developer conveyance gear 32 so as to compress the compression spring 71 (in the direction of the arrow V). At this time, the axial force applied to the drive transmission portions 72*c* and 72*d* of the engagement member 72 is larger than the force applied to the engagement member 72 from the compression spring 71. And, when the drive transmission portions 72*c* and 72*d* reach a position (non-transmission position) (See FIG. 10B) where they are in contact with an apex 32*c* of the cam surface 32*b* of the developer conveyance gear 32, the rotational drive transmission from the conveyance member gear 32 to the engagement member 72 ceases to be conducted.

At this time, the conveyance member gear 32 idles. Through this operation, the drive transmission to the developer conveyance member 25 is cut off, and the rotation of the developer conveyance member 25 is decelerated and stopped.

That is, the engagement member 72 is a moving member movable between a position where drive force is transmitted to the developer conveyance member 25 (drive transmission position) (See FIG. 10A) and a position where no drive force is transmitted to the developer conveyance member 25 (non-transmission position) (See FIG. 10B). When the engagement member 72 is at the drive transmission position, the developer conveyance member 25 rotates. The engagement member 72 is being urged toward the drive transmission position by the compression spring 71. However, when the requisite drive force (load torque) for driving the developer conveyance member 25 exceeds a predetermined magnitude, it moves from the drive transmission position to the non-transmission position. Through this operation, the transmission of drive to the developer conveyance ember 25 is interrupted, and the rotation of the developer conveyance member 25 stops.

In the present exemplary embodiment, the engagement member 72 moves in the direction V twice for one drive cycle of the developer conveyance gear 32. The requisite torque for rotating the developer conveyance member 25 is reduced to a fixed level or less, the driving (rotation) of the developer conveyance member 25 is started by the cam surface 32*b* of the developer conveyance gear 32. While in the present exemplary embodiment the number of times that the engagement member 72 moves is two for one drive cycle of the developer conveyance gear 32, this should not be construed restrictively. It is also possible to increase the number of times that it moves per cycle. Due to the above-described simple construction, in which solely the compression spring 71 and the engagement member 72 are added, it is possible to cut off the drive transmission whenever the load torque becomes a fixed level or more.

Further, as illustrated in FIG. 9, the spring receiving surface 72*e* of the engagement member 72 is provided with three holes 72*g*. The holes 72*g* are through-holes extending through the engagement member 72. They allow passage of developer when the engagement member 72 moves. That is, when the engagement member 72 moves, the developer can pass through the holes 72*g*, so that it is possible to reduce the resistance offered to the engagement member 72 by the developer.

As illustrated in FIG. 1, in the present exemplary embodiment, the clutch portion 70 is arranged inside the developer storage portion 15 (the first storage portion 15*b*) and at an end portion of the developer conveyance member 25, and faces the first opening 17. Due to the provision of the clutch portion 70 inside the developer storage portion 15, the portion of the developer situated around the clutch portion 70 cannot be conveyed in the developer conveyance direction J by the developer conveyance member 25.

In view of this, in the present exemplary embodiment, the winding direction of the compression spring 71 is the same as the winding direction of a screw portion (developer conveyance portion) 25*f* of the developer conveyance member 25. That is, when the compression spring 71 is seen from the upstream side (the right-hand side in FIG. 1) in the direction J in which the developer is conveyed by the developer conveyance member 25, the coil forming the compression spring 71 is wound from the upstream side to the downstream side in the developer conveyance direction J, i.e., in a direction reverse to the rotating direction of the developer conveyance member 25.

Due to this construction, when the compression spring 71 rotates upon receiving a drive force from the conveyance member gear 32 at the time of driving the developer conveyance member 25, the compression spring 71 can convey the developer in the developer conveyance direction J by using the coil thereof. Thus, when the clutch portion 70 receives a drive force from the development stirring gear 31, the compression spring (compression coil spring) 71 serves as a conveyance portion (clutch side conveyance portion) for conveying the developer in the developer conveyance direction J. As a result, even in the case where the clutch portion 70 is provided in the developer storage portion 15, it is possible for the developer to be conveyed by the clutch portion 70 itself.

It is also possible to provide the clutch portion 70 with a plurality of conveyance portions. In the present exemplary embodiment, a fin portion 72*f* (See FIG. 8) of a spiral rib configuration is provided in the outer periphery of the spring receiving portion 72*e* of the engagement member 72 to which the compression spring 71 is mounted. The fin portion 72*f* is a conveyance portion (second clutch side conveyance portion) provided on the engagement member 72 for conveying the developer.

The spiral winding direction of the fin portion 72*f* is the same as that of the spiral configuration of the screw portion 25*f* of the developer conveyance member 25. When, at the time of driving of the developer conveyance member 25, the engagement member 72 rotates upon receiving the drive force from the conveyance member gear 32, it is possible to convey the developer in the developer conveyance direction J by the fin portion 72*f*.

Further, the spring receiving portion 25*e* of the developer conveyance member 25 is provided with a hole 25*g*, making it possible to efficiently deliver to the screw portion 25*f* of the developer conveyance member 25 the developer conveyed by the compression spring 71 and the fin portion 72*f* of the engagement member 72. Thus, the hole 25*g* is a through-hole extending through the developer conveyance member 25, and permits passage of the developer conveyed by the clutch portion 70.

As described above, in the present exemplary embodiment, the clutch portion 70 is on the upstream side of the developer conveyance member 25 in the developer conveyance direction J, that is, on the upstream side of the screw portion (developer conveyance portion) 25*f*.

Thus, even when the developer is coagulated on the downstream side in the developer conveyance direction J and the load applied to the screw portion 25*f* (the developer conveyance member 25) from the toner increases, the density of the developer is relatively low around the clutch portion 70, which is situated on the upstream side in the developer conveyance direction J.

Thus, even if, at this time, the engagement member 72 moves when the transmission of the drive force from the conveyance member gear 32 to the screw portion 25*f* (developer conveyance member 25) is cut off, the resistance force offered to the engagement member 72 from the developer is small. As a result, the clutch portion 70 reliably cuts off the transmission of the drive force without involving any operational defect due to the developer.

Further, according to the present exemplary embodiment, also in the case where the clutch portion 70 is provided inside the developer storage portion 15 in order to attain a reduction in apparatus size, it is possible to convey the developer while suppressing stay of the developer around the clutch portion 70.

While in the present exemplary embodiment the clutch portion 70 is applied to the drive route to the developer conveyance member 25, which is under maximum load, this should not be construed restrictively. It is also possible to apply the clutch portion 70 to the drive route to the developer stirring member 24. Further, while in the present exemplary embodiment there is adopted a developer conveyance apparatus using the clutch portion 70 in the process cartridge, it is also possible to adopt the construction of the developer conveyance apparatus described above in the developer replenishment cartridge T.

Further, the construction of the clutch portion 70 is not restricted to that of the present exemplary embodiment. That is, it is only necessary to be able to cut off or reduce the magnitude of the drive force transmitted to the clutch when the load applied to the screw portion 25*f* (the requisite force for rotating the screw portion 25*f*) increases. As a result, it is possible to stop or decelerate the rotation of the screw portion 25*f* (developer conveyance member 25), so that the load received by the screw portion 25*f* from the toner is reduced and, by extension, it is also possible to reduce the load applied to the motor for rotating the screw portion. Here, by providing the clutch on the upstream side of the developer conveyance member 25 (on the upstream side of the screw portion 25*f*), it is possible to suppress generation of operational defect in the clutch due to the pressure of the toner or the like when it is necessary to operate the clutch. Further, in particular, when the clutch has a moving member, it is possible to suppress operational defect in the clutch by providing the moving member with a through-hole permitting passage of toner. Further, by providing the clutch with a clutch side conveyance portion configured to convey toner (developer) in the same direction as the screw portion 25*f*, it is possible to suppress deterioration in toner conveyance property around the clutch.

In the developer conveyance apparatus according to the first exemplary embodiment described above, the clutch portion 70 can convey the developer by the compression spring 71 and the engagement member 72. In the second exemplary embodiment described below with reference to FIG. 11, a cover member 73 is added in order to further improve the conveyance property obtained by the clutch portion 70 according to the first exemplary embodiment. The arrangement and operation of the engagement member 72 and the compression spring 71 according to the present exemplary embodiment are the same as those of the first exemplary embodiment, so the same components are indicated by the same reference numerals, and a description thereof will be left out.

Figure 11:
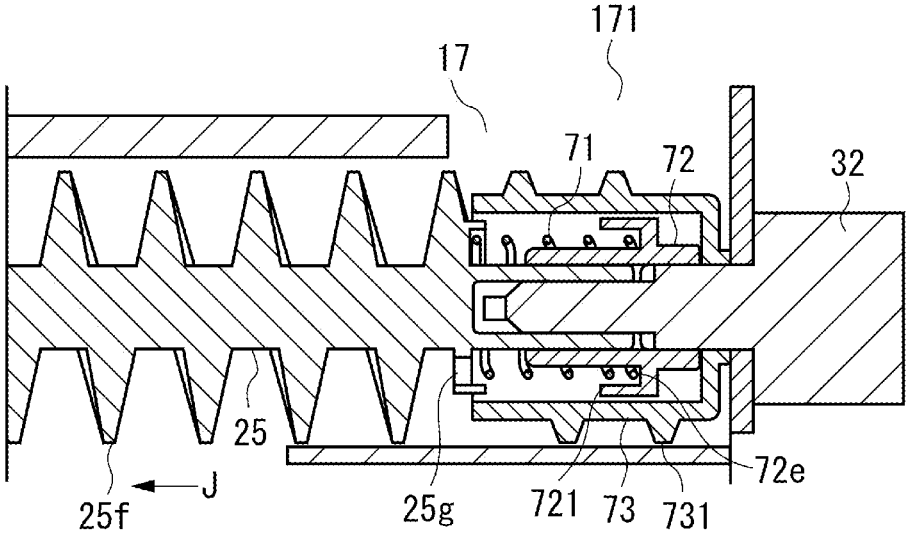
FIG. 11 is a schematic sectional view of the clutch portion according to the second exemplary embodiment.

FIG. 11 is an enlarged sectional view of a clutch portion 170 according to the present exemplary embodiment. In the present exemplary embodiment, the developer conveyance apparatus includes the developer conveyance member 25, the conveyance member gear 32, and the clutch portion 170. The clutch portion 170 is composed of the engagement member 72, the compression spring 71, and the cover member 73. Here, as illustrated in FIG. 11, the cover member 73 is coaxially fixed to the conveyance member gear 32, and is arranged so as to cover the engagement member 72 and the compression spring 71. Further, in the outer periphery of the cover member 73, there is provided a spiral fin portion 73*f*. The winding direction of the spiral configuration of the fin portion 73*f* is the same as that of the developer conveyance member 25, and it is possible to convey the developer in the developer conveyance direction J through the rotation of the conveyance member gear 32. Further, the developer having entered the interior of the cover member 73 is conveyed by the compression spring 71 and the fin portion 72*f* of the engagement member 72, and is discharged through the gap between the cover member 73 and the developer conveyance member 25 and through the hole 25*g* provided in the developer conveyance member 25. Further, in the present exemplary embodiment, no hole is formed in the spring receiving portion 72*e* of the engagement member 72. The reason for this is to discharge the developer inside the cover member 73 through movement of the engagement member 72 in the direction J in which the developer is conveyed by the developer conveyance member 25 when an excessive load is applied to the developer conveyance member 25.

More specifically, the non-transmission position where the engagement member 72 transmits no drive force to the developer conveyance member 25 is on the downstream side of the drive transmission position where drive force is transmitted to the developer conveyance member 25. Thus, through movement of the engagement member 72 from the drive transmission position to the non-transmission position, it is possible to convey the developer in the movable range for the engagement member 72 in the developer conveyance direction J to remove the same.

In this way, in the present exemplary embodiment, independently of the operation of the engagement member 72 and of the developer conveyance member 25, it is possible to convey the developer by the fin portion 73*f* of the cover member 73 in response to the rotation of the conveyance member gear 32. Further, through movement of the engagement member 72 from the drive transmission position to the non-transmission position, it is possible to convey the developer in the movable range for the engagement member 72 by the spring receiving portion 72*e* of the engagement member 72.

As described above, according to the present exemplary embodiment, even in the case where the clutch portion 170 is provided inside the developer storage portion 15 in order to attain a reduction in apparatus size, it is possible to convey the developer while suppressing staying of the developer around the clutch portion 170.

While in the present exemplary embodiment the cover member 73 is formed as a member separate from the conveyance member gear 32, they may also be formed as an integral unit. Further, while the fin portion 73*f* of the cover member 73 is formed in a spiral configuration, this should not be construed restrictively. The effect can be attained by arranging an inclined rib. Further, also in the developer replenishment cartridge of a similar drive construction, the dame effect can be attained by adopting the construction of the present exemplary embodiment described above.

In the first exemplary embodiment and the second exemplary embodiment, the drive transmission mechanism such as the engagement member 72 of the clutch portion 70 and the clutch portion 170 is exposed to the developer. In the third exemplary embodiment described below with reference to FIG. 12, the drive transmission mechanism is kept out of contact with the developer.

Figure 12:
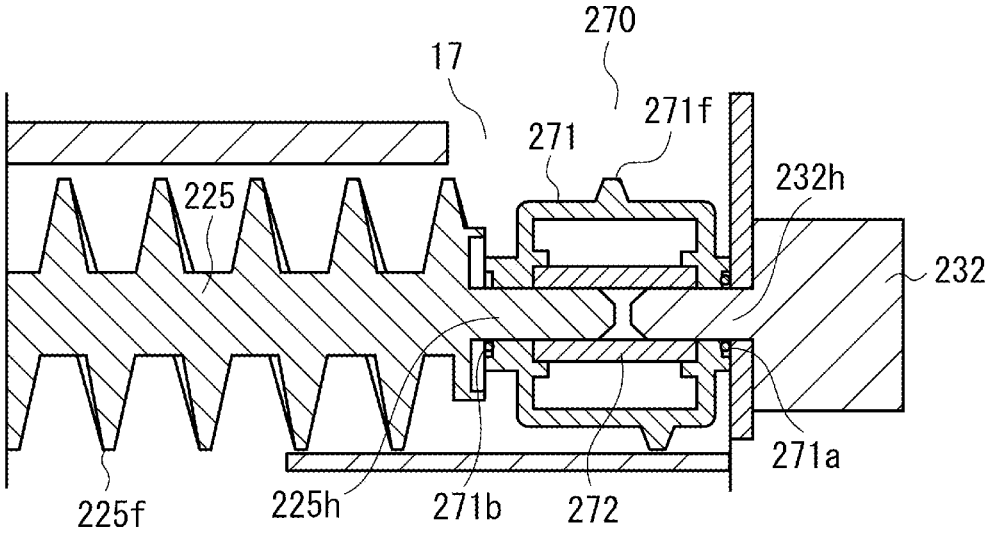
FIG. 12 is a schematic sectional view of the clutch portion according to the third exemplary embodiment.

FIG. 12 is an enlarged sectional view of a clutch portion 270 according to the present exemplary embodiment. As illustrated in FIG. 12, the developer conveyance apparatus according to the present exemplary embodiment includes the clutch portion 270, and a developer stirring gear 232 and a developer conveyance member 225, which are coaxially engaged therewith. The clutch portion 270 is formed by a cover member 271 and a torque limiter 272. The torque limiter 272 is arranged between the developer stirring gear 232 and the developer conveyance member 225, and is configured to idle when an excessive load is applied to the developer conveyance member 225.

The torque limiter 272 is a drive transmission portion transmitting drive to the developer conveyance member 225. The torque limiter 272 can assume a drive transmission state in which it is engaged with the developer conveyance member 225 to transmit a drive force to the developer conveyance member, and a regulation state in which the drive transmission state is canceled to regulate the transmission of the drive force to the developer conveyance member.

The cover member 271 is fixed to the torque limiter 272, and is arranged so as to cover the torque transmitter 272. Both axial end portions of the cover member 271 are respectively engaged with a shaft portion 225*h* of the developer conveyance member 225 and a shaft portion 232*h* of the developer stirring gear 232. At the portions of the cover member 271 engaged with the shaft portions 225*h* and 232*h*, there are arranged seal members 271*a* and 271*b*, preventing developer from entering the interior of the cover member 271. In the outer periphery of the cover member 271, there is formed a spiral protrusion-like fin portion 271*f*. The winding direction of the spiral configuration of the fin portion 271*f* is the same as that of the screw portion 25*f* of the developer conveyance member 25. When the developer conveyance member 25 is driven, the developer can be conveyed in the developer conveyance direction J by the fin portion 271*f*. Thus, the cover member 271 is a conveyance portion which rotates integrally with the developer stirring gear 232, conveying the developer in the developer conveyance direction J.

As described above, according to the present exemplary embodiment, even when the clutch portion 270 is provided inside the developer storage portion 15 in order to achieve a reduction in apparatus size, it is possible to suppress the influence of the developer on the drive transmission mechanism. At the same time, it is possible to convey the developer while suppressing staying of the developer around the clutch portion 270.

In particular, according to the present exemplary embodiment, the cover member 271 is rotated by receiving drive force from the conveyance member gear 232 serving as the drive input portion, so that it is always possible to convey the developer by the fin portion 271*f* of the cover member 271 independently of the operation of the torque limiter 272.

Further, the cover member 271 suppresses intrusion of the developer into the torque limiter 272, so that malfunction of the torque limiter 272 is suppressed, making it possible to reliably convey the developer by the developer conveyance member 225.

While in the present exemplary embodiment the driving of the developer conveyance member 25 is controlled by using the torque limiter 272 as the drive transmission portion, this should not be construed restrictively. It is also possible to use, as the drive transmission portion, the compression spring 71 and the engagement member 72 described in relation to the first and second exemplary embodiments, or a friction clutch, or a one-way clutch or the like. Further, while in the present exemplary embodiment the fin portion 271*f* of the cover member 271 is formed in a spiral configuration, this should not be construed restrictively. A similar effect can be achieved by arranging an inclined rib. Further, while in the present exemplary embodiment the cover member 271 is fixed to the torque limiter 272, it may also be fixed to the conveyance member gear 32 or the developer conveyance member 25. Further, by using the above-described construction according to the present exemplary embodiment also in the developer replenishment cartridge of a similar drive construction, it is possible to achieve a similar effect.

According to the present exemplary embodiment, independently of the operation of the clutch portion, the conveyance portion rotates in conformity with the drive input portion. Since it is possible to convey the developer in conformity with the drive input portion due to the fin-like protrusion provided on the conveyance portion, it is possible to achieve compatibility between reduction in the size of a developer conveyance apparatus with a clutch function and developer conveyance property.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A developer conveyance apparatus for use in an image forming apparatus, the developer conveyance apparatus comprising:

a developer storage portion configured to store developer;

a developer conveyance portion arranged inside the developer storage portion and configured to convey the developer through rotation along a rotation axis thereof;

a supplying opening configured to supply the developer to an exterior of the developer storage portion; and a clutch configured to transmit a drive force to the developer conveyance portion, the clutch stopping or decelerating a rotation of the developer conveyance portion, when a requisite torque for rotating the developer conveyance portion exceeds a predetermined magnitude, by suppressing transmission of the drive force to the developer conveyance portion, wherein the developer storage portion includes:

a first storage portion in which the developer conveyance portion is provided and having the supplying opening;

a second storage portion;

an upstream side opening configured to allow the first storage portion and the second storage portion to communicate with each other, the upstream side opening being provided on an upstream side of the developer storage portion in a developer conveyance direction in which the developer conveyance portion coveys the developer; and a downstream side opening configured to allow the first storage portion and the second storage portion to communicate with each other, the downstream side opening being provided on an downstream side of the developer storage portion in the developer conveyance direction, wherein when the developer conveyance portion rotates, the developer circulates between the first storage portion and the second storage portion through the upstream side opening and the downstream side opening, and wherein the clutch is arranged inside the first storage portion, is provided on an upstream side of the developer conveyance portion in the developer conveyance direction, and is opposed to the upstream side opening.

2. The developer conveyance apparatus according to claim 1, wherein when the developer conveyance portion rotates and the developer circulates between the first storage portion and the second storage portion, a speed of the developer moving within the first storage portion is faster than a speed of the developer moving within the second storage portion.

3. The developer conveyance apparatus according to claim 1 further comprising:

a sealing member configured to seal the supplying opening;

a removing member configured to remove the sealing member; and a transmitting mechanism configured to transmit the drive force from the image forming apparatus to the removing member and the clutch, wherein when the clutch stops or decelerates the rotation of the developer conveyance portion, the removing member removes the sealing member from the supplying opening by receiving the drive force from the transmitting mechanism.

4. The developer conveyance apparatus according to claim 3, wherein the removing member removes the sealing member so that the supplying opening is opened from a downstream side in the developer conveyance direction.

5. The developer conveyance apparatus according to claim 1, wherein the clutch includes:

a moving member configured to move to a drive transmission position to transmit the drive force to the developer conveyance portion to rotate the developer conveyance portion while contacting the developer; and an elastic member configured to urge the moving member toward the drive transmission position.

6. The developer conveyance apparatus according to claim 1, wherein a developer stirring member configured to stir the developer is provided inside the second storage portion.

7. The developer conveyance apparatus according to claim 1, wherein the developer conveyance apparatus conveys the developer from the developer storage portion to a development portion in which a developer bearing member is arranged.

8. The developer conveyance apparatus according to claim 1, wherein the clutch includes a clutch side conveyance portion configured to convey, in the developer conveyance direction, the developer moved from the second storage portion to the first storage portion through the upstream side opening.

9. A process cartridge detachably attachable to an apparatus main body of an image forming apparatus, the process cartridge comprising:

an image bearing member on which a latent image is formed;

a developer bearing member configured to develop the latent image by using developer;

a developer storage portion configured to store developer to be borne by the developer bearing member;

a developer conveyance portion arranged inside the developer storage portion and configured to convey the developer through rotation along a rotation axis thereof;

a supplying opening configured to supply the developer to an exterior of the developer storage portion, and a clutch configured to transmit a drive force to the developer conveyance portion, the clutch stopping or decelerating a rotation of the developer conveyance portion, when a requisite torque for rotating the developer conveyance portion exceeds a predetermined magnitude, by suppressing transmission of the drive force to the developer conveyance portion;

wherein the developer storage portion includes:

a first storage portion in which the developer conveyance portion is provided and having the supplying opening;

a second storage portion;

an upstream side opening configured to allow the first storage portion and the second storage portion to communicate with each other, the upstream side opening being provided on an upstream side of the developer storage portion in a developer conveyance direction in which the developer conveyance portion coveys the developer; and a downstream side opening configured to allow the first storage portion and the second storage portion to communicate with each other, the downstream side opening being provided on an downstream side of the developer storage portion in the developer conveyance direction, wherein when the developer conveyance portion rotates, the developer circulates between the first storage portion and the second storage portion through the upstream side opening and the downstream side opening, and, wherein the clutch is arranged inside the first storage portion, is provided on an upstream side of the developer conveyance portion in the developer conveyance direction, and is opposed to the upstream side opening.

10. The process cartridge according to claim 9, wherein when the developer conveyance portion rotates, the developer circulates between the first storage portion and the second storage portion, and a speed of the developer moving within the first storage portion is faster than a speed of the developer moving within the second storage portion.

11. The process cartridge according to claim 9 further comprising:

a sealing member configured to seal the supplying opening;

a removing member configured to remove the sealing member; and a transmitting mechanism configured to transmit the drive force from the image forming apparatus to the removing member and the clutch, wherein when the clutch stops or decelerates the rotation of the developer conveyance portion, the removing member removes the sealing member from the supplying opening by receiving the drive force from the transmitting mechanism.

12. The process cartridge according to claim 11, wherein the removing member removes the sealing member so that the supplying opening is opened from a downstream side in the developer conveyance direction.

13. The process cartridge according to claim 9, wherein the clutch includes:

a moving member configured to move to a drive transmission position to transmit the drive force to the developer conveyance portion to rotate the developer conveyance portion while contacting the developer; and an elastic member configured to urge the moving member toward the drive transmission position.

14. The process cartridge according to claim 9, wherein a developer stirring member configured to stir the developer is provided inside the second storage portion.

15. The process cartridge according to claim 9, further comprising:

a development portion in which the developer bearing member is arranged, wherein the developer conveyance portion conveys the developer from the developer storage portion to the development portion.

16. The process cartridge according to claim 9, wherein the clutch includes a clutch side conveyance portion configured to convey, in the developer conveyance direction, the developer moved from the second storage portion to the first storage portion through the upstream side opening.

* * * * *